US005385276A

United States Patent [19]

Yen-Tang

[11] Patent Number: 5,385,276

[45] Date of Patent: Jan. 31, 1995

[54] LIQUID DISPENSER FOR PET BOTTLES

[76] Inventor: Lin Yen-Tang, P.O. Box 82-144, Taipei, Taiwan, Prov. of China

[21] Appl. No.: 229,209

[22] Filed: Apr. 18, 1994

[51] Int. Cl.[6] ..... B65D 83/14

[52] U.S. Cl. ..... 222/400.8; 222/401; 222/533; 222/78

[58] Field of Search ..... 222/78, 400.8, 401.533

[56] References Cited

U.S. PATENT DOCUMENTS

| | | | |
|---|---|---|---|
| 2,031,172 | 2/1936 | Maloney | 222/401 X |
| 2,038,915 | 4/1936 | Unger | 222/78 |
| 2,060,512 | 11/1936 | Magill | 222/400.8 |
| 2,312,067 | 2/1943 | Bates | 222/400.8 X |
| 3,207,387 | 9/1965 | Brickman | 222/400.8 |
| 4,350,273 | 9/1982 | Nezworski et al. | 222/400.8 |
| 4,436,227 | 3/1984 | Johnson, Jr. et al. | 222/400.8 X |
| 4,711,377 | 12/1987 | Brown | 222/401 X |
| 4,828,147 | 5/1989 | Wiedmann | 222/400.8 X |
| 4,860,931 | 8/1989 | Hubbard | 222/400.8 |
| 4,877,158 | 10/1989 | Kohler | 222/400.8 |

*Primary Examiner*—Andres Kashnikow
*Assistant Examiner*—Kenneth Bomberg
*Attorney, Agent, or Firm*—Alfred Lei

[57] ABSTRACT

A liquid dispenser for a PET bottle including an upper cover formed with an opening, a lower cover engaged with the upper cover and having a slot, a cylinder inserted through the opening of the upper cover and fixedly mounted on the lower cover, a piston disposed within the upper chamber of the cylinder and fixedly connected with a lid, a spring-loaded slide member movably fitted within the recess of the cylinder and pivotally connected with a handle extending out of the slot of the lower cover, and a mouth plate pivotally connected with the lower cover and having an outlet connected with the nozzle of the cylinder via a pipe.

2 Claims, 6 Drawing Sheets

LIQUID DISPENSER FOR PET BOTTLES

BACKGROUND OF THE INVENTION

It has been found that the conventional PET bottles are sealed with an aluminum cap. However, the carbon dioxide will run away from the beverage once the aluminum cap is opened. Further, it will be inconvenient especially for children to hold and lift a PET bottle with a volume more than 2000 c.c.

Hence, a number of liquid dispensers have been developed to meet such need and examples of these liquid dispensers are illustrated in U.S. Pat. No. 2,060,512 to Magil, U.S. Pat. No. 2,069,383 to Nedbalek, U.S. Pat. No. 4,274,562 to Medeiros et al, U.S. Pat. No. 4,320,856 to Stewart et al, U.S. Pat. No. 4,550,864 to Tarozzi et al, U.S. Pat. No. 4,711,377 to Brown, U.S. Pat. No. 4,986,452 to Takatsuki et al, U.S. Pat. No. 5,110,014 to Doundoulakis, French Pat. No. 23099 to Bouillon, and Japanese Pat. No. 75600 to Takeda. However, most of them are complicated in structure and can be directly fitted with a PET bottle. For example, the Nedbalek Patent is directed to a liquid dispenser, but it is too sophisticated in structure and is not especially adapted for use with a PET bottle.

Therefore, it is an object of the present invention to provide a liquid dispenser for PET bottles which may obviate and mitigate the above-mentioned drawbacks.

SUMMARY OF THE INVENTION

This invention relates to a liquid dispenser for PET bottles.

It is the primary object of the present invention to provide a liquid dispenser for PET bottles which may withdraw the beverage therein simply by pressing the dispenser.

It is another object of the present invention to provide a liquid dispenser for PET bottles which may withdraw all beverage out of the PET bottles.

It is still another object of the present invention to provide a liquid dispenser for PET bottles which is easy to operate.

It is still another object of the present invention to provide a liquid dispenser for PET bottles which is simple in construction.

It is a further object of the present invention to provide a liquid dispenser for PET bottles which is economic to produce.

The invention accordingly consists of features of constructions and method, combination of elements, arrangement of parts and steps of the method which will be exemplified in the constructions and method hereinafter disclosed, the scope of the application of which will be indicated in the claim following.

DETAILED DESCRIPTION OF THE PREFERRED EMBODIMENT

Figure 1:
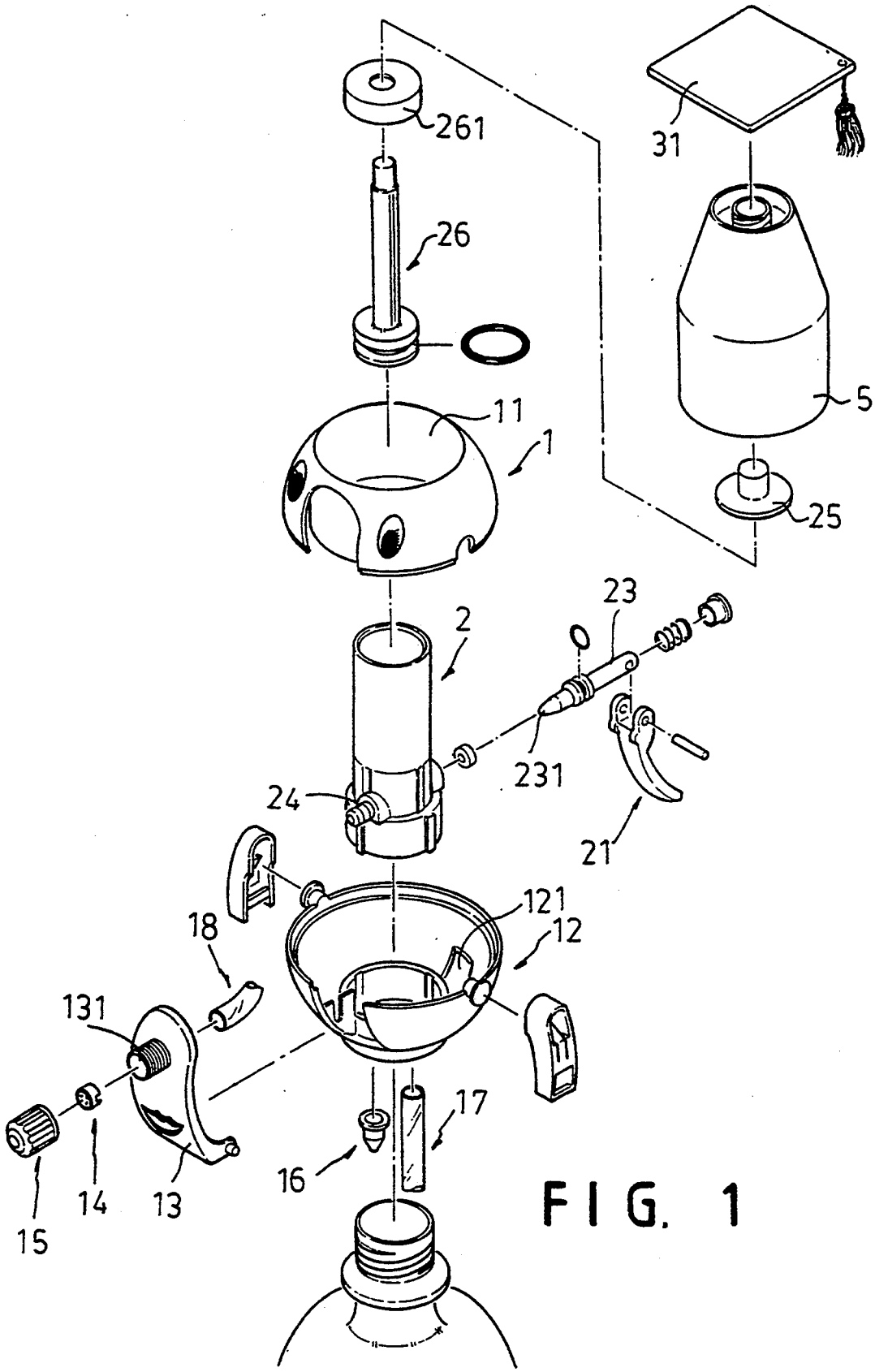
FIG. 1 is an exploded view of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
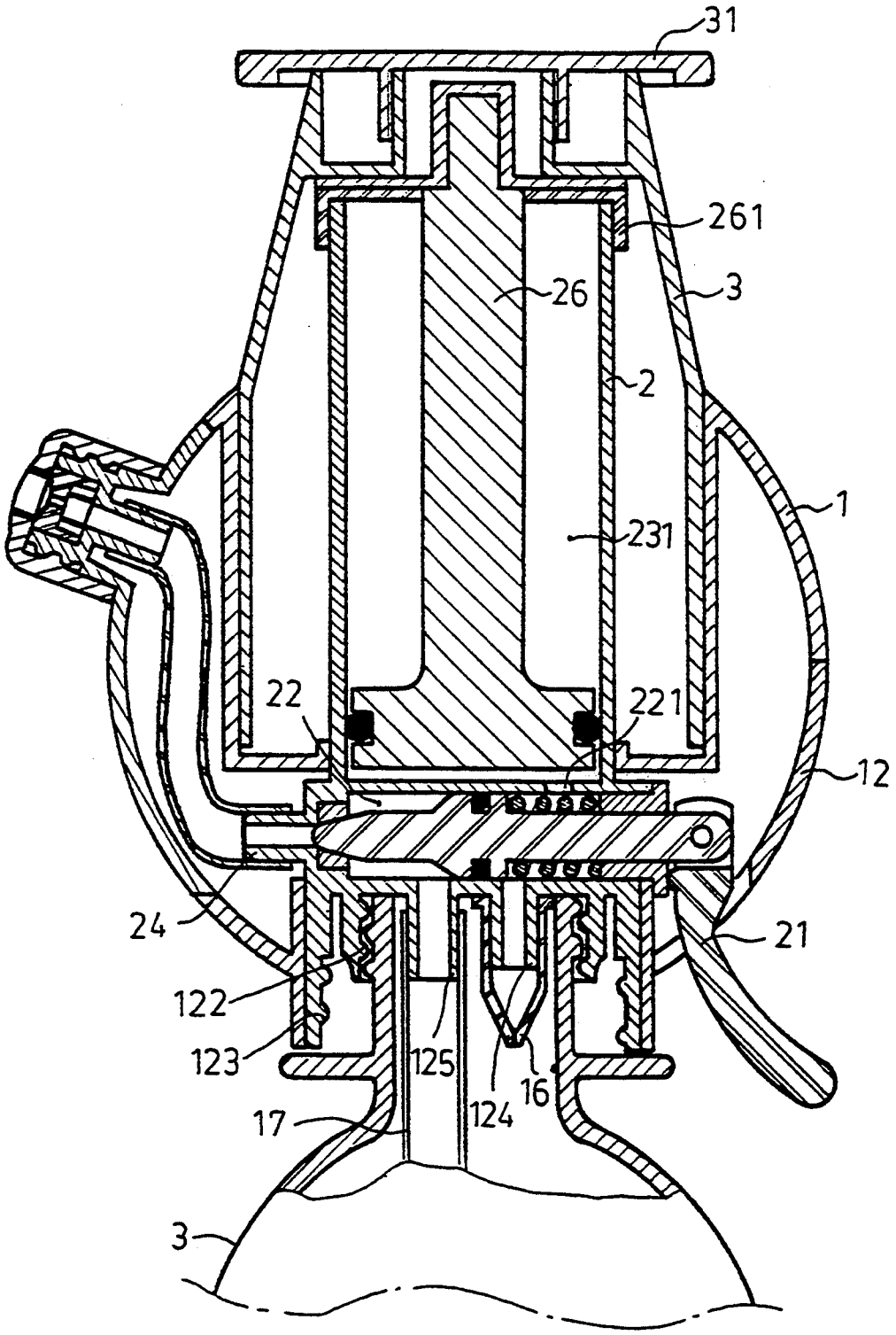
FIG. 2 is a sectional view of the present invention.
Figure 3:
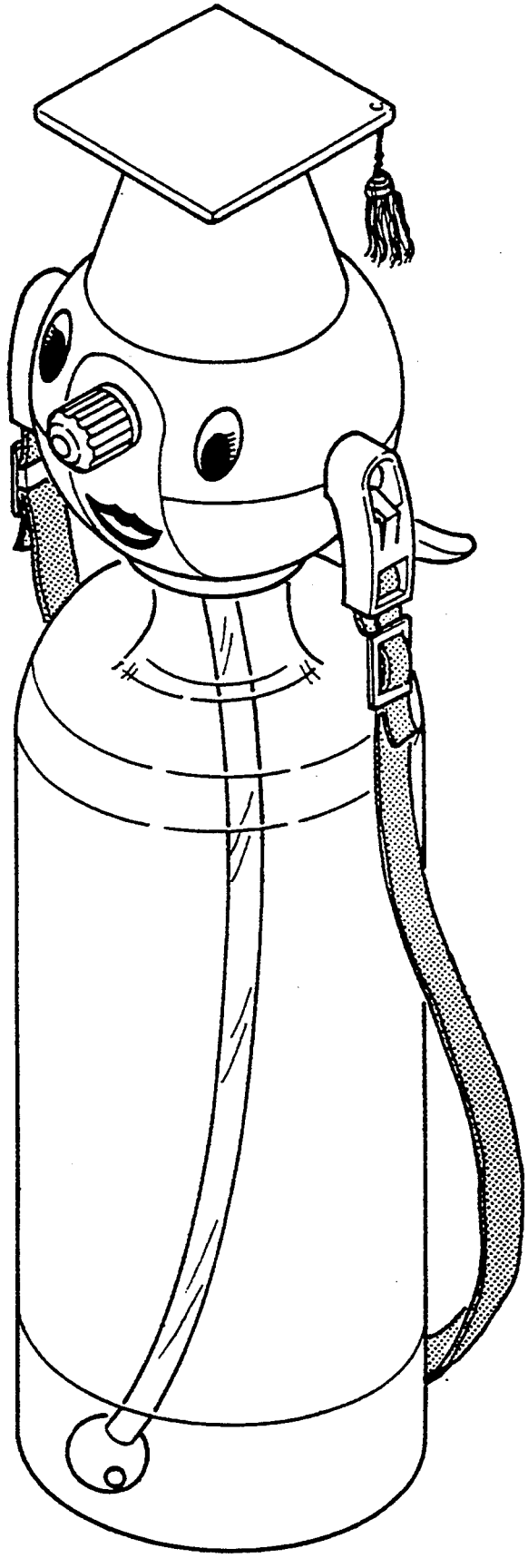
FIG. 3 is a perspective view of the present invention.

With reference to the drawings and in particular to FIGS. 1, 2 and 3 thereof, the liquid dispenser for a PET bottle according to the present invention comprises an upper cover 1 in shape of a lovely cartoon figure. The upper cover 1 is formed with an opening 11 through which is inserted a cylinder 2 having an upper chamber 231, a recess 22 communicated with the upper chamber 231 via a perforation 221, and a nozzle 24 communicated with the recess 22. Within the recess 22 is movably fitted a spring-loaded slide member 23 which is pivotally connected at the outer end with a handle 21 and engageable with the outlet 24 of the cylinder 2. The cylinder 2 is fixedly mounted in a lower cover 12 engaged with the upper cover 1 and formed with a slot 121 for the passage of the handle 21. Further, the lower cover 12 is pivotally connected with a mouth plate 13 having an outlet 131 in which is fitted a filter 14. A cap 15 is threadedly engaged with the outlet 131 of the mouth plate 13. Disposed within the cylinder 2 is a piston 26 on which is fitted an annular member 261. On the top of the cylinder 2 is fixedly fitted a lid 25. A cup-shaped member 5 is engaged with the upper cover I and provided with a base 31 threadedly engaged with the top so that the cup-shaped member 5 may be used as a cup for receiving liquid.

In addition, the lower cover 12 is formed at the lower portion with a first downwardly depending neck portion 122 adapted to engage the mouth of a PET bottle 3 and a second downwardly depending neck portion 123 adapted to engage the mouth of a larger PET bottle (not shown). Furthermore, the bottom portion of the cylinder 2 is formed with a first tubular member 124 adapted to engage a check valve 16 and a second tubular member 125 adapted to engage a pipe 17 extending downwardly nearly to the bottom of the PET bottle 3. Moreover, the nozzle 24 of the cylinder 2 is connected with the outlet 131 of the mouth plate 3 via a pipe 18.

Figure 4:
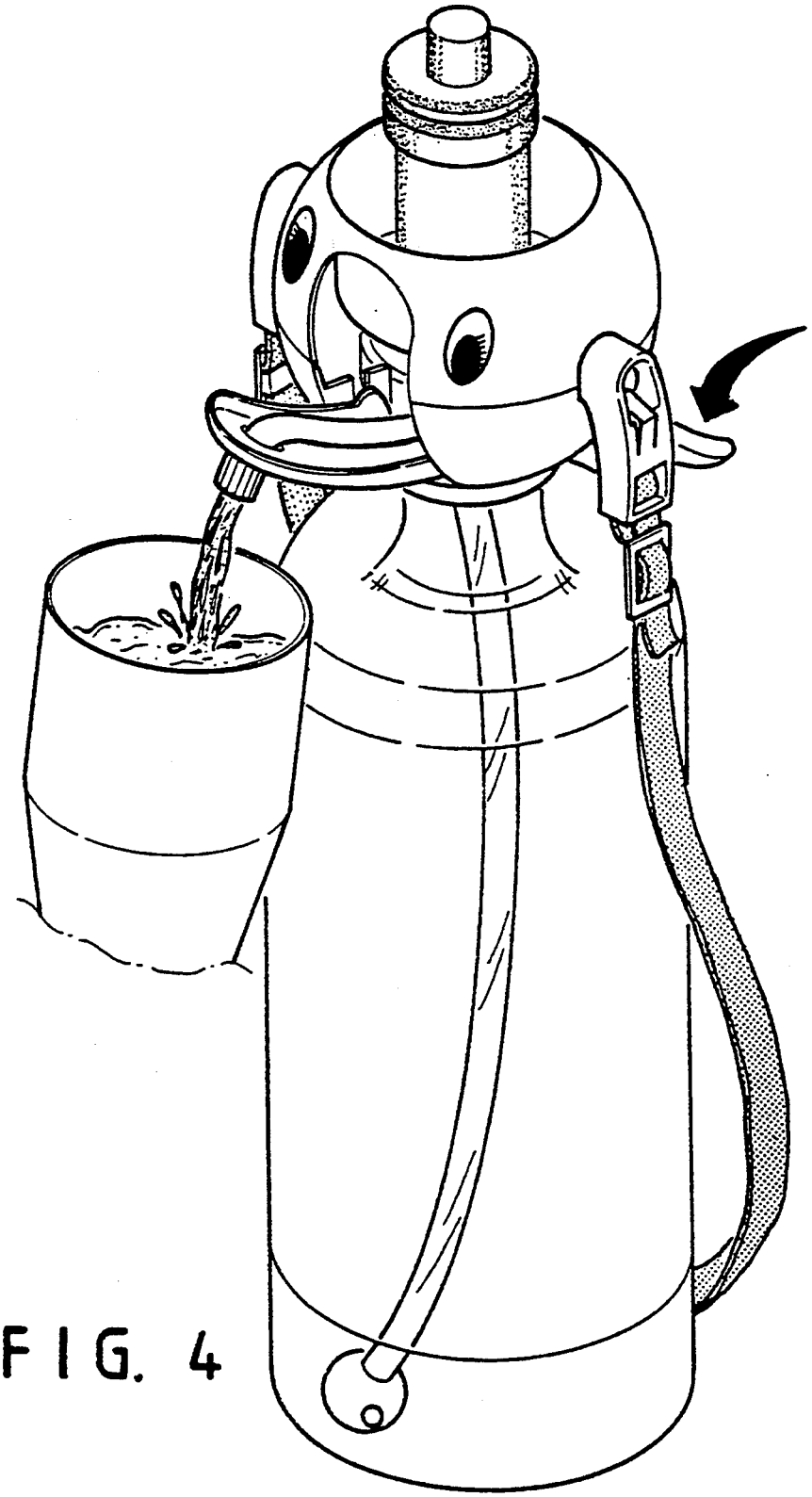
FIG. 4 is a first working view of the present invention.
Figure 5:
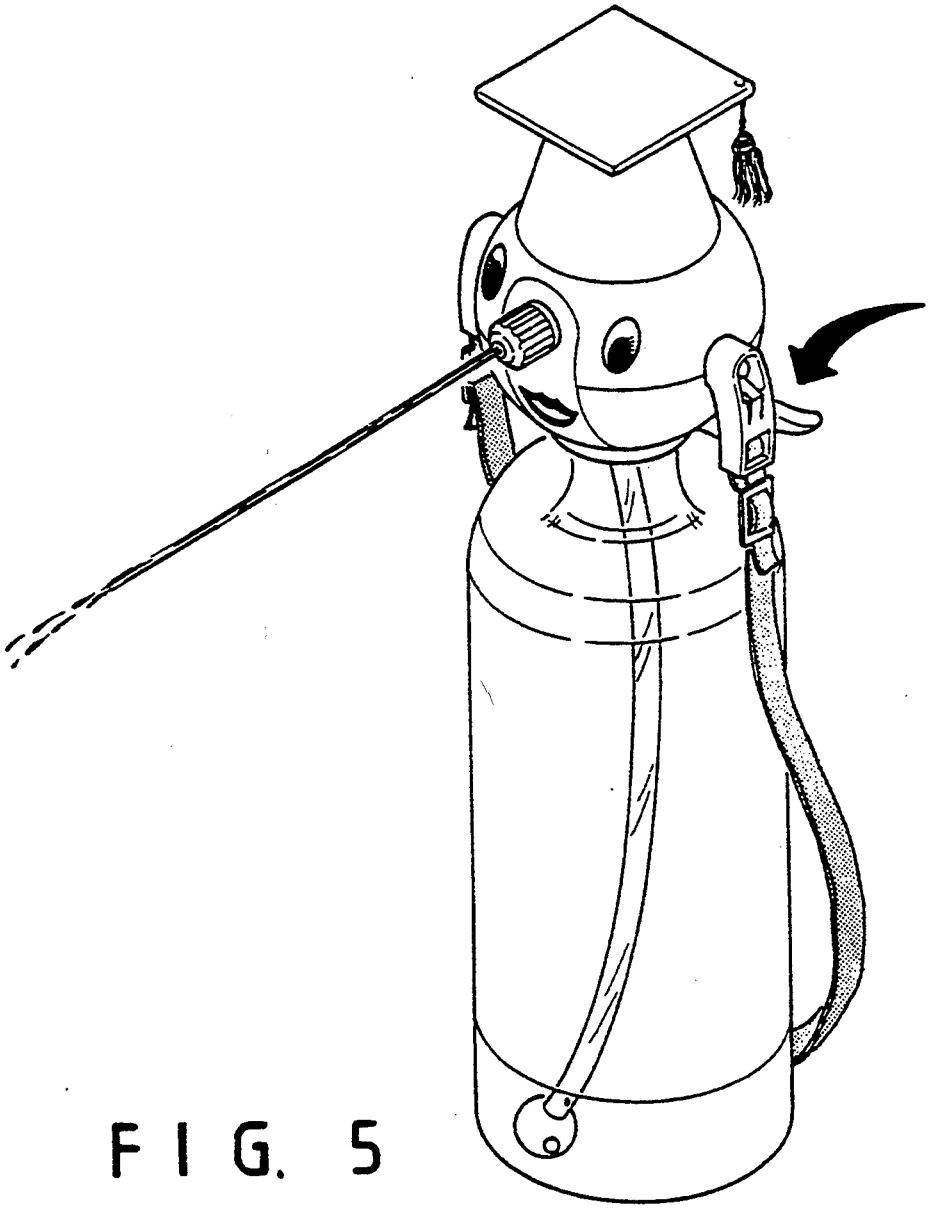
FIG. 5 is a second working view of the present invention.
Figure 6:
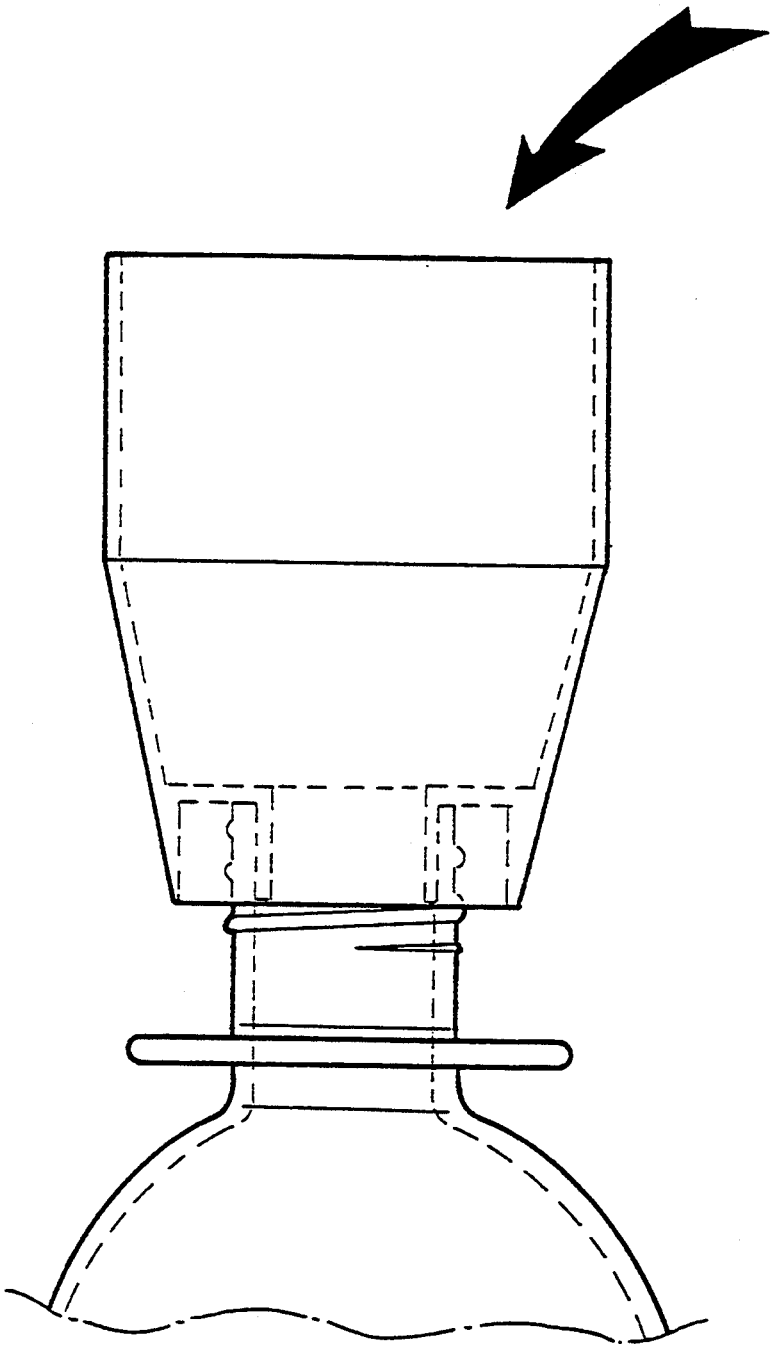
FIG. 6 is a third working view of the present invention.

When in use, it is only necessary to pull and press the handle 21 alternately so that the liquid in the PET bottle 3 will be forced out of the outlet 131 of the mouth plate 13 by the carbon dioxide within the PET bottle 3 However, as the carbon dioxide is not sufficient to force the liquid out of the outlet 131 of the mouth plate 13, simply remove the cup-shaped member 5 and move the lid 25 together with the piston 26 up and down to force air into the PET bottle 3 via the perforation 221 and the check valve 16. Further, the mouth plate 13 may be pulled out for use as shown in FIG. 4. Furthermore, the filter 14 may be replaced may be replaced with one through which liquid may be ejected out of the outlet 131 of the mouth plate 13 as shown in FIG. 5. Besides, the cup-shaped member 5 may be engaged with the mouth of the PET bottle 5 as shown in FIG. 6.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A liquid dispenser for a PET bottle comprising:

an upper cover formed with an opening;

a lower cover engaged with said upper cover and having a slot, said lower cover further having a first downwardly depending neck adapted to engage a PET bottle and a second downwardly depending neck adapted to engage a larger PET bottle;

a cylinder inserted through the opening of said upper cover and fixedly mounted on said lower cover, said cylinder having an upper chamber, a recess communicated with said upper chamber and a nozzle communicated with said recess, said cylinder being formed at a bottom with a first tubular member adapted to engage a check valve and a second tubular member adapted to engage a pipe extending downwardly to a bottom of said PET bottle;

a piston disposed within the upper chamber of said cylinder and fixedly connected with a lid;

a spring-loaded slide member movably fitted within the recess of said cylinder and pivotally connected with a handle extending out of the slot of said lower cover; and a mouth plate pivotally connected with said lower cover and having an outlet connected with the nozzle of said cylinder via a pipe.

2. The liquid dispenser for a PET bottle as claimed in claim 1, further comprising a cup-shaped member adapted to engage said upper cover.

* * * * *